US005809959A

United States Patent [19]

Martinsson

[11] Patent Number: 5,809,959

[45] Date of Patent: Sep. 22, 1998

[54] SECURING DEVICE FOR AN INTAKE TUBE OF AN INTERNAL COMBUSTION ENGINE

[75] Inventor: Pär Martinsson, Jönköping, Sweden

[73] Assignee: Aktiebolaget Electrolux, Stockholm, Sweden

[21] Appl. No.: 929,630

[22] Filed: Sep. 15, 1997

[30] Foreign Application Priority Data

Oct. 25, 1996 [SE] Sweden ..... 9603910

[51] Int. Cl.[6] ..... F02M 31/00

[52] U.S. Cl. ..... 123/184.21

[58] Field of Search ..... 123/184.21, 184.32, 123/184.39, 184.46, 41.31, 198 E

[56] References Cited

U.S. PATENT DOCUMENTS 3,769,954 11/1973 Morgenroth ..... 123/198 E 3,916,860 11/1975 Nakano et al. ..... 123/547

4,099,496 7/1978 Nagase et al. ..... 123/41.31

*Primary Examiner*—David A. Okonsky

*Attorney, Agent, or Firm*—Pearne, Gordon, McCoy & Granger LLP

[57] ABSTRACT

In an internal combustion engine, especially for a motor saw, a securing device is used for connecting one end of a flexible intake tube (12) to an inlet tube socket (11) of a cylinder (10). The other end of the intake tube is adapted to be connected to a fuel supply system, such as a carburetor (17). A partition wall (13) is provided between the cylinder and the carburetor in order to protect the carburetor from heat radiation from the cylinder. According to the invention,the partition wall (13) is made integral with a clamp (14) adapted to surround and secure one end of the intake tube (12) to the inlet tube socket (11).

2 Claims, 1 Drawing Sheet

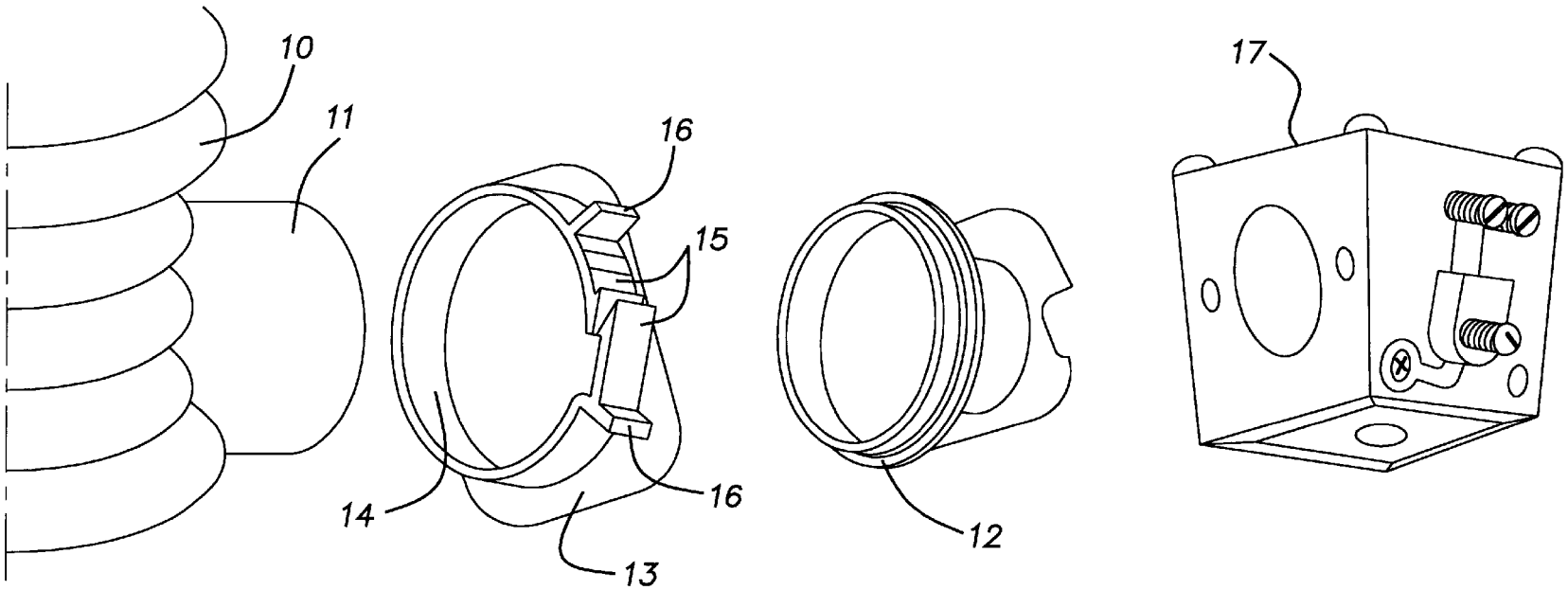
17
12
16
15
16
13
14
11
10

SECURING DEVICE FOR AN INTAKE TUBE OF AN INTERNAL COMBUSTION ENGINE

The present invention relates to a securing device for connecting one end of a flexible intake tube to an inlet tube socket of a cylinder of an internal combustion piston engine, especially in a motor saw, the other end of said intake tube being adapted to be connected to a fuel supply system, especially a carburetor, which is separated from said cylinder by a partition wall.

In motor saws, a flexible intake tube, which is usually made of rubber, is commonly used between the carburetor and the inlet tube socket of the cylinder in order to prevent transmission of engine vibrations to the carburetor. The carburetor is protected from heat radiation from the cylinder by means of a partition wall provided between the carburetor and the cylinder. The intake tube extends through an opening in the partition wall and is attached to the inlet tube socket by means of a screw terminal, or the like.

The object of the invention is to provide a securing device which allows the intake tube to be mounted in a more rapid and simple manner and consequently provides a reduction of cost and labour. Another object is to reduce the number of details required, whereby a further reduction of cost is made possible. This has been achieved by means of a securing device of the kind mentioned in the introduction which according to the invention is characterized in that it comprises a clamp which is made integral with said partition wall and adapted to surround and secure said one end of said intake tube to said inlet tube socket.

The invention will be described in more detail in the following with reference to the accompanying drawing, which shows an exploded perspective view of the securing device according to the invention.

In the drawing, a portion of a cylinder 10 is shown diagrammatically which forms a part of an internal combustion engine and is provided with an inlet tube socket 11.

A flexible intake tube 12 is adapted to be connected at one of its ends to the inlet tube socket 11 and at its other end to a carburetor 17. A partition wall 13 is provided between the cylinder 10 and the carburetor 17 in order to protect the carburetor from heat radiation. The partition wall is made integral with a clamp 14 provided with interconnecting latches 15 and protrusions 16 adapted to be actuated by a tool, as will be described in the following.

During assembly of the device, the end of the intake tube 12 facing the cylinder 10 is applied onto the inlet tube socket 11, and the partition wall 13 is subsequently mounted onto the intake tube in such way that the clamp 14 surrounds the mentioned end thereof. By means of a pair of tongs or a similar, suitable tool the protrusions 16 of the clamp are pressed towards each other so as to interconnect the latches 15. When the clamp 14 is compressed in this way around the intake tube 12, the latter will in turn be clamped around the inlet tube socket 11 in order to be firmly secured thereto. The described clamp can also be easily disassembled by releasing the latches 15 from each other by means of a pair of tongs or a screw driver.

I claim:

1. Securing device for connecting one end of a flexible intake tube (12) to an inlet tube socket (11) of a cylinder (10) of an internal combustion piston engine, especially in a motor saw, the other end of said intake tube being adapted to be connected to a fuel supply system, especially a carburetor (17), which is separated from said cylinder by a partition wall (13), characterized in that it comprises a clamp (14) which is made integral with said partition wall (13) and adapted to surround and secure said one end of said intake tube (12) to said inlet tube socket (11).

2. Securing device according to claim 1, characterized in that the clamp (14) comprises at least two interconnectable latches (15).

* * * * *